US010395613B2

(12) United States Patent
Chen et al.

(10) Patent No.: US 10,395,613 B2
(45) Date of Patent: Aug. 27, 2019

(54) DRIVE CONTROL CIRCUIT AND LIQUID CRYSTAL DISPLAY DEVICE

(71) Applicant: Wuhan China Star Optoelectronics Technology Co., Ltd., Wuhan, Hubei (CN)

(72) Inventors: Caiqin Chen, Guangdong (CN); Yu Zhao, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 79 days.

(21) Appl. No.: 15/535,666

(22) PCT Filed: Mar. 30, 2017

(86) PCT No.: PCT/CN2017/078751
§ 371 (c)(1),
(2) Date: Jun. 13, 2017

(87) PCT Pub. No.: WO2018/170942
PCT Pub. Date: Sep. 27, 2018

(65) Prior Publication Data

US 2018/0366079 A1 Dec. 20, 2018

(30) Foreign Application Priority Data

Mar. 21, 2017 (CN) ..... 2017 1 0172709

(51) Int. Cl.
*G09G 3/36* (2006.01)

(52) U.S. Cl.
CPC ..... *G09G 3/3648* (2013.01); *G09G 3/3607* (2013.01); *G09G 2310/0264* (2013.01);
(Continued)

(58) Field of Classification Search
CPC ..... G09G 3/3648; G09G 3/3607; G09G 2310/0264; G09G 2310/021
See application file for complete search history.

(56) References Cited

U.S. PATENT DOCUMENTS

2014/0307004 A1* 10/2014 Roh ..... G09G 3/3208 345/690
2016/0019846 A1* 1/2016 Kim ..... G09G 3/3406 345/690
2017/0061890 A1* 3/2017 Zhou ..... G09G 3/3266

FOREIGN PATENT DOCUMENTS

CN 103855192 A 6/2014
CN 103943082 A 7/2014
(Continued)

*Primary Examiner* — Towfiq Elahi
(74) *Attorney, Agent, or Firm* — Andrew C. Cheng

(57) ABSTRACT

Disclosed is a drive control circuit, comprising a sub pixel set, a thin film transistor set, a switching unit and a driver, the driver comprises a control end, a row drive end and a column drive end, the sub pixel set comprises a plurality of sub pixels arranged in array, and the thin film transistor set comprises thin film transistors arranged in array, and one thin film transistor corresponds to one sub pixel, and the sub pixel set comprises at least one mixed sub pixel column, having at least two different sub pixels, connected to the switching unit via corresponding thin film transistors, and the control ends of the thin film transistors corresponding to the at least one mixed sub pixel column are connected to the row drive end, and the switching unit is also connected to the column drive end and the control end.

14 Claims, 3 Drawing Sheets

(52) U.S. Cl.
CPC ..... *G09G 2310/0297* (2013.01); *G09G 2330/021* (2013.01)

(56) References Cited

FOREIGN PATENT DOCUMENTS

| | | | |
|---|---|---|---|
| CN | 105118430 | A | 12/2015 |
| CN | 105869599 | A | 8/2016 |
| KR | 20140109697 | A | 9/2014 |

* cited by examiner

DRIVE CONTROL CIRCUIT AND LIQUID CRYSTAL DISPLAY DEVICE

CROSS REFERENCE

This application claims the priority of Chinese Patent Application No. 2017101727093, entitled "Drive control circuit and liquid crystal display device", filed on Mar. 21, 2017, the disclosure of which is incorporated herein by reference in its entirety.

FIELD OF THE INVENTION

The present invention relates to a display technical field, and more particularly to a drive control circuit and a liquid crystal display device.

BACKGROUND OF THE INVENTION

With the constant development and progress of liquid crystal display technology, the LCD display device pixel (RGB, red, green and blue) structure accordingly changes. In comparison with the traditional RGB structure, the pentile pixel structure appears after the OLED (Organic Light Emitting Diode) display. For the pentile pixel structure of the same resolution with the use of sub pixel sharing, the actual drive signals are reduced, which means decrease of the wiring density. For the pentile pixel structure, at least one column comprises at least two different sub-pixels (such as R and G) and then, the drive chip outputs a composite signal to the column of sub pixels to meet the display requirements. However, the output of the composite signal needs to drive the chip for complex algorithm conversion, which makes the drive chip power consumption very large to increase the power consumption of liquid crystal display device.

SUMMARY OF THE INVENTION

An objective of the present invention is to provide a drive control circuit to reduce the drive power consumption.

Another objective of the present invention is to provide a liquid crystal display device.

For realizing the aforesaid objective, the technical solution provided by the embodiments of the present invention is:

The present invention provides a drive control circuit, applied in a liquid crystal display device, and the drive control circuit comprises a sub pixel set, a thin film transistor set, a switching unit, and a driver, and the driver comprises a control end, a row drive end and a column drive end, and the sub pixel set comprises a plurality of sub pixels arranged in array, and the thin film transistor set comprises thin film transistors arranged in array with the same amount of the sub pixels, and one thin film transistor corresponds to one sub pixel, wherein the sub pixel set comprises at least one mixed sub pixel column, and the mixed sub pixel column comprises at least two different sub pixels, and the at least one mixed sub pixel column is connected to the switching unit via corresponding thin film transistors, and the control ends of the thin film transistors corresponding to the at least one mixed sub pixel column are connected to the row drive end, and the switching unit is also connected to the column drive end and the control end, and the control end outputs at least two signals to the switching unit and cooperates with a row by row scan of the row drive end so that the column drive end charges sub pixels corresponded with thin film transistors of a scanned row, wherein an amount of the at least two signals is the same as an amount of the at least two different sub pixels.

The mixed sub pixel column comprises a first sub pixel and a second sub pixel, and the switching unit comprises at least one set of electrical switches, and each set of electrical switches corresponds to one mixed sub pixel column, and each set of electrical switches comprises a first electrical switch and a second electrical switch, and the at least two signals comprise a first signal and a second signal, and a control end of the first electrical switch is connected to a control end of the driver to receive the first signal, and a first end of the first electrical switch is connected to the column drive end, and a second end of the first electrical switch is connected to the first sub pixel, and a control end of the second electrical switch is connected to the control end of the driver to receive the second signal, and a first end of the second electrical switch is connected to the column drive end, and a second end of the second electrical switch is connected to the second sub pixel, and the control end outputs the first signal and the second signal to the switching unit and cooperates with the row by row scan of the row drive end so that the column drive end charges the sub pixels corresponded with the thin film transistors of the scanned row.

The mixed sub pixel column further comprises a third sub pixel, and the third sub pixel is different from the first sub pixel and the second pixel, and each set of electrical switches further comprises a third electrical switch, and the at least two signals further comprise a third signal, and a control end of the third electrical switch is connected to the control end of the driver to receive the third signal, and a first end of the third electrical switch is connected to the column drive end, and a second end of the third electrical switch is connected to the third sub pixel, and the control end outputs the first signal, the second signal and the third signal to the switching unit and cooperates with the row by row scan of the row drive end so that the column drive end charges the sub pixels corresponded with the thin film transistors of the scanned row.

The control end of the driver comprises a first output end, a second output end and a third output end, and the first output end is connected to the control end of the first electrical switch to output the first signal, and the second output end is connected to the control end of the second electrical switch to output the second signal, and the third output end is connected to the control end of the third electrical switch to output the third signal.

The first sub pixel is a red sub pixel, and the second sub pixel is a blue sub pixel, and the third sub pixel is a green sub pixel.

The first electrical switch, the second electrical switch and the third electrical switch are all PNP type field effect transistors, and the control ends, the first ends and the second ends of the first electrical switch, the second electrical switch and the third electrical switch respectively are gates, drains and sources of field effect transistors.

A structure of the sub pixel set is a pentile pixel structure.

The present invention further provides a liquid crystal display device, comprising the aforesaid drive control circuit.

The embodiments of the present invention have advantages or benefits:

The drive control circuit of the present invention is applied in the liquid crystal display device and comprises a switching unit. The driver comprises a control end, a row drive end and a column drive end, and the at least one mixed sub pixel column is connected to the switching unit via corresponding thin film transistors, and the control ends of the thin film transistors corresponding to the at least one mixed sub pixel column are connected to the row drive end, and the switching unit is also connected to the column drive end and the control end, and the control end outputs at least two signals to the switching unit and cooperates with a row by row scan of the row drive end so that the column drive end charges sub pixels corresponded with thin film transistors of a scanned row. Thus, the driver does not need to perform a complex synthesis algorithm and to output a composite signal for charge control of the at least one mixed sub pixel column, thereby reducing power consumption.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are merely part of embodiments of the present invention, but not all embodiments. Based on the embodiments of the present invention, all other embodiments to those of ordinary skill in the premise of no creative efforts obtained, should be considered within the scope of protection of the present invention.

Besides, the following descriptions for the respective embodiments are specific embodiments capable of being implemented for illustrations of the present invention with referring to appended figures. For example, the terms of up, down, front, rear, left, right, interior, exterior, side, etcetera are merely directions of referring to appended figures. Therefore, the wordings of directions are employed for explaining and understanding the present invention but not limitations thereto.

In the description of the invention, which needs explanation is that the term "installation", "connected", "connection" should be broadly understood unless those are clearly defined and limited, otherwise, For example, those can be a fixed connection, a detachable connection, or an integral connection; those can be a mechanical connection, or an electrical connection; those can be a direct connection, or an indirect connection with an intermediary, which may be an internal connection of two elements. To those of ordinary skill in the art, the specific meaning of the above terminology in the present invention can be understood in the specific circumstances.

Besides, in the description of the present invention, unless with being indicated otherwise, "plurality" means two or more. In the present specification, the term "process" encompasses an independent process, as well as a process that cannot be clearly distinguished from another process but yet achieves the expected effect of the process of interest. Moreover, in the present specification, any numerical range expressed herein using "to" refers to a range including the numerical values before and after "to" as the minimum and maximum values, respectively. In figures, the same reference numbers will be used to refer to the same or like parts.

Figure 1:
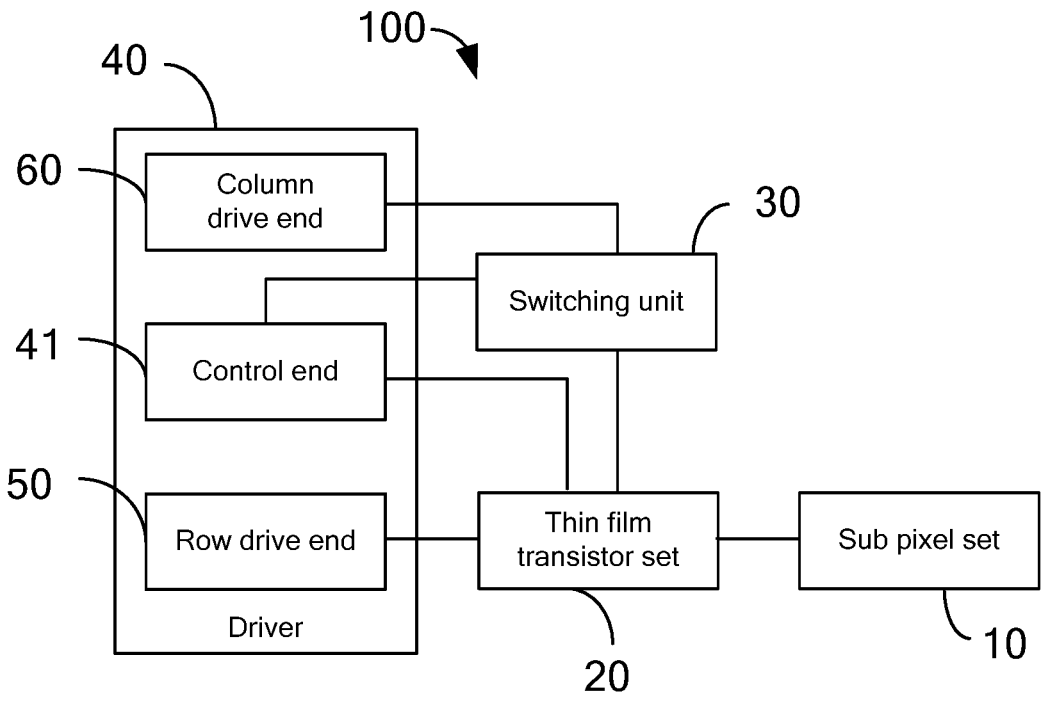
FIG. 1 is a block diagram of a drive control circuit provided by the first embodiment of the first solution according to the present invention.
Figure 2:
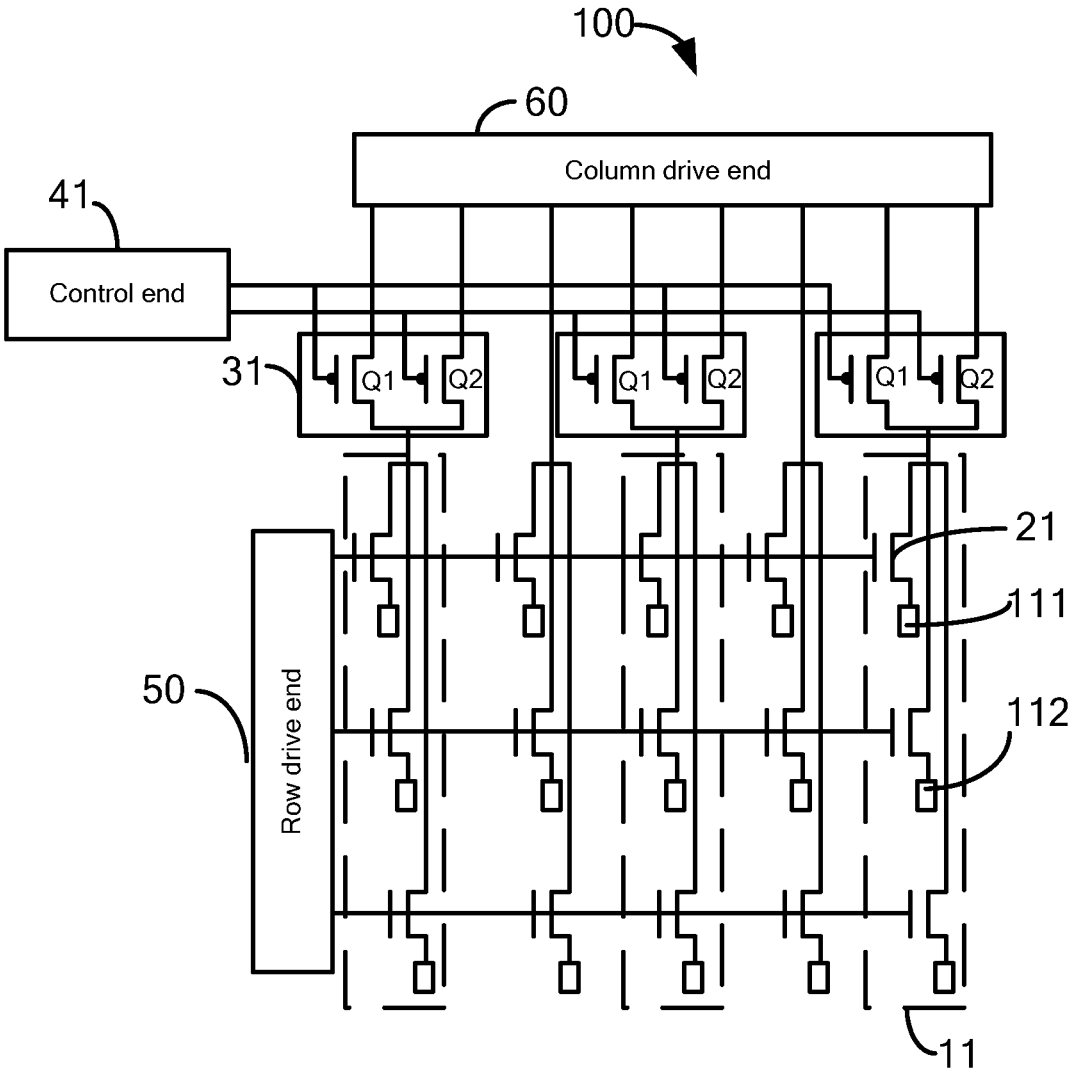
FIG. 2 is a circuit diagram of FIG. 1.

Please refer to FIG. 1 and FIG. 2. The first embodiment of the first solution according to the present invention provides a drive control circuit 100. The drive control circuit 100 is applied in a liquid crystal display device. The drive control circuit 100 comprises a sub pixel set 10, a thin film transistor set 20, a switching unit 30, and a driver 40. The driver 40 comprises a control end 41, a row drive end 50 and a column drive end 60. The sub pixel set 10 comprises a plurality of sub pixels arranged in array, and the thin film transistor set 20 comprises thin film transistors 21 arranged in array with the same amount of the sub pixels, and one thin film transistor 21 corresponds to one sub pixel, wherein the sub pixel set 10 comprises at least one mixed sub pixel column 11, and the mixed sub pixel column comprises at least two different sub pixels, and the at least one mixed sub pixel column is connected to the switching unit 30 via corresponding thin film transistors, and the control ends of the thin film transistors corresponding to the at least one mixed sub pixel column are connected to the row drive end 50, and the switching unit 30 is also connected to the column drive end 60 and the control end 41. The control end 41 outputs at least two signals to the switching unit 30 and cooperates with a row by row scan of the row drive end 50 so that the column drive end 60 charges sub pixels corresponded with thin film transistors 21 of a scanned row, wherein an amount of the at least two signals is the same as an amount of the at least two different sub pixels.

In this embodiment, the mixed sub pixel column 11 comprises a first sub pixel 111 and a second sub pixel 112, and the first sub pixel 111 and the second sub pixel 112 are different. The switching unit 30 comprises at least one set of electrical switches 31. Each set of electrical switches 31 corresponds to one mixed sub pixel column 11, and each set of electrical switches 31 comprises a first electrical switch Q1 and a second electrical switch Q2, and the at least two signals comprise a first signal and a second signal, and a control end of the first electrical switch Q1 is connected to a control end 41 of the driver 40 to receive the first signal, and a first end of the first electrical switch Q1 is connected to the column drive end 60, and a second end of the first electrical switch Q1 is connected to the first sub pixel 111, and a control end of the second electrical switch Q2 is connected to the control end 41 of the driver 40 to receive the second signal, and a first end of the second electrical switch Q2 is connected to the column drive end 60, and a second end of the second electrical switch Q2 is connected to the second sub pixel 112. The control end 41 outputs the first signal and the second signal to the switching unit 30 and cooperates with the row by row scan of the row drive end 50 so that the column drive end 60 charges the sub pixels corresponded with the thin film transistors of the scanned row.

Specifically, in this embodiment, the first sub pixel 111 can be a red sub pixel, and the second sub pixel 112 can be a blue sub pixel. The first electrical switch Q1 and the second electrical switch Q2 are PNP type field effect transistors, and the control ends, the first ends and the second ends of the first electrical switch Q1 and the second electrical switch Q2 respectively are gates, drains and sources of field effect transistors. A structure of the sub pixel set 10 is a pentile pixel structure. In other embodiments, the first sub pixel 111 and the second sub pixel 112 also can be sub pixels of other colors according to the practical requirement. The first electrical switch Q1 and the second electrical switch Q2 also can be transistors of other types. The structure of the sub pixel set 10 can also be other results as long as there is at least one mixed sub pixel column.

In this embodiment, the drive control circuit 100 comprises the switching unit 30. The driver 40 comprises a control end 41, a row drive end 50 and a column drive end 60. The at least one mixed sub pixel column is connected to the switching unit 30 via corresponding thin film transistors, and the control ends of the thin film transistors corresponding to the at least one mixed sub pixel column are connected to the row drive end 50, and the switching unit 30 is also connected to the column drive end 60 and the control end 41. The control end 41 outputs at least two signals to the switching unit 30 and cooperates with a row by row scan of the row drive end 50 so that the column drive end 60 charges sub pixels corresponded with thin film transistors 21 of a scanned row, wherein an amount of the at least two signals is the same as an amount of the at least two different sub pixels. Therefore, the driver 40 in the embodiment of the present invention outputs at least two signals to control the switching unit 30 via the control end thereof and cooperates with the row drive end 50 to perform charge control of the at least one mixed sub pixel column 11 without performing a complex synthesis algorithm and outputting a composite signal for charge control of the at least one mixed sub pixel column 11, thereby reducing power consumption.

The working principle of the driving control circuit 100 is now described with reference to an illustration. It is assumed that the sub pixel set is a matrix structure of three rows and five columns. The first column, the third column, and the fifth column are mixed sub pixel columns. In the first mixed sub pixel column, the first sub pixel 111 is located in the first row and the second sub pixel 112 is located in the second row. In the third mixed sub pixel column, the first sub pixel 111 is located in the second row and the second sub pixel 112 is located in the first row. In the fifth mixed sub pixel column, the first sub pixel 111 is located in the first row and the second sub pixel 112 is located in the second row. Each mixed sub pixel column corresponds to one switching unit 30. When the row drive end 50 activates the first row of thin film transistors 21, the control end 41 turns on the first electric switch Q1 and turns off the second electric switch Q2 so that the column drive end 60 charges the first sub pixel 111 of the first row. When the row drive end 50 activates the second row of thin film transistors 21, the control end 41 turns on the second electric switch Q2 and turns off the first electric switch Q1 so that the column drive end 60 charges the second sub pixel 112 of the second row.

Figure 3:
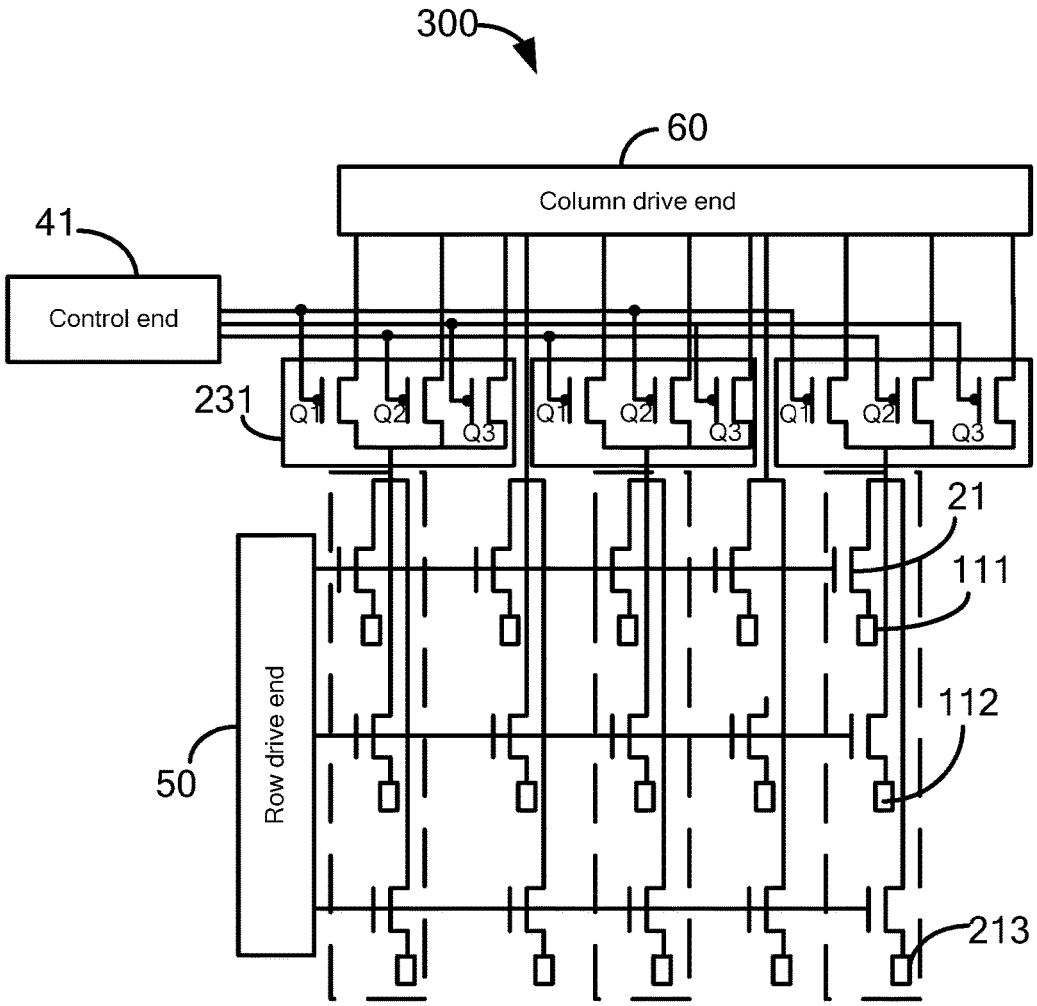
FIG. 3 is a circuit diagram of a drive control circuit provided by the second embodiment of the first solution according to the present invention.

Please refer to FIG. 3. The second embodiment of the first solution according to the present invention provides a drive control circuit 200. The drive control circuit 200 provided by the second embodiment of the first solution according to the present invention is similar to the drive control circuit 100 provided by the first embodiment, and the difference of the two is: in the second embodiment, the mixed sub pixels further comprise a third sub pixel 213. The third sub pixel 213 is different from the first sub pixel 111 and the second pixel 112, and each set of electrical switches 231 further comprises a third electrical switch Q3, and the at least two signals further comprise a third signal, and a control end of the third electrical switch Q3 is connected to the control end 41 of the driver 40, and a first end of the third electrical switch Q3 is connected to the column drive end 60, and a second end of the third electrical switch Q3 is connected to the third sub pixel 213. The control end 41 outputs the first signal, the second signal and the third signal to the switching unit 30 and cooperates with the row by row scan of the row drive end 50 so that the column drive end 60 charges the sub pixels corresponded with the thin film transistors of the scanned row.

Specifically, the driver 40 in the embodiment of the present invention outputs the first signal, the second signal and the third signal to control the switching unit 30 via the control end thereof and cooperates with the row drive end 50 to perform charge control of the at least one mixed sub pixel column 11 without performing a complex synthesis algorithm and outputting a composite signal for charge control of the at least one mixed sub pixel column 11, thereby reducing power consumption.

Specifically, the control end 41 comprises a first output end, a second output end and a third output end, and the first output end is connected to the control end of the first electrical switch Q1 to output the first signal, and the second output end is connected to the control end of the second electrical switch Q2 to output the second signal, and the third output end Q3 is connected to the control end of the third electrical switch to output the third signal.

The second embodiment of the present invention provides a liquid crystal display device. The liquid crystal display device comprises a drive control circuit. In this embodiment, the drive control circuit can be the drive control circuit 100 in the aforesaid first solution. The drive control circuit 100 has already described in the aforesaid first solution in detail. The repeated description is omitted here.

In this embodiment, the liquid crystal display device comprises the drive control circuit 100. The drive control circuit 100 comprises a switching unit 30. The driver 40 comprises a control end 41, a row drive end 50 and a column drive end 60. The at least one mixed sub pixel column is connected to the switching unit 30 via corresponding thin film transistors, and the control ends of the thin film transistors corresponding to the at least one mixed sub pixel column are connected to the row drive end 50, and the switching unit 30 is also connected to the column drive end 60 and the control end 41. The control end 41 outputs at least two signals to the switching unit 30 and cooperates with a row by row scan of the row drive end 50 so that the column drive end 60 charges sub pixels corresponded with thin film transistors 21 of a scanned row, wherein an amount of the at least two signals is the same as an amount of the at least two different sub pixels. Therefore, the driver 40 in the embodiment of the present invention outputs at least two signals to control the switching unit 30 via the control end thereof and cooperates with the row drive end 50 to perform charge control of the at least one mixed sub pixel column 11 without performing a complex synthesis algorithm and outputting a composite signal for charge control of the at least one mixed sub pixel column 11, thereby reducing power consumption of the driver 40 and reducing power consumption of the liquid crystal display device.

In the description of the present specification, the reference terms, "one embodiment", "some embodiments", "an illustrative embodiment", "an example", "a specific example", or "some examples" mean that such description combined with the specific features of the described embodiments or examples, structure, material, or characteristic is included in the utility model of at least one embodiment or example. In the present specification, the terms of the above schematic representation do not certainly refer to the same embodiment or example. Meanwhile, the particular features, structures, materials, or characteristics which are described may be combined in a suitable manner in any one or more embodiments or examples.

Above are embodiments of the present invention, which does not limit the scope of the present invention. Any modifications, equivalent replacements or improvements within the spirit and principles of the embodiment described above should be covered by the protected scope of the invention.

What is claimed is:

1. A drive control circuit, applied in a liquid crystal display device, wherein the drive control circuit comprises a sub pixel set, a thin film transistor set, a switching unit, and a driver, and the driver comprises a control end, a row drive end and a column drive end, and the sub pixel set comprises a plurality of sub pixels arranged in an array that includes a first number of sub pixels, and the thin film transistor set comprises thin film transistors arranged in an array that comprises a second number of thin film transistors, the second number being identical to the first number of the sub pixels, such that the thin film transistors respectively correspond to the sub pixels, wherein the sub pixel set comprises at least one mixed sub pixel column, and the mixed sub pixel column comprises at least two different sub pixels, and the at least one mixed sub pixel column is connected to the switching unit via the ones of the thin film transistors that correspond to the at least two different sub pixels, and control ends of the thin film transistors corresponding to the at least one mixed sub pixel column are connected to the row drive end, and the switching unit is also connected to the column drive end and the control end of the driver, and the control end outputs at least two signals to the switching unit and cooperates with a row by row scan of the row drive end so that the column drive end charges sub pixels corresponded with thin film transistors of a scanned row, wherein the at least two different sub pixels comprises a third number of different sub pixels and the at least two signals comprises a fourth number of signals and the fourth number is the same as the third number of the at least two different sub pixels, wherein the switching unit comprises at least one set of electrical switches that connects the at least one mixed sub pixel column to the column drive end; and wherein the at least one set of electrical switches comprises at least two electrical switches that are arranged parallel to each other and the at least one mixed sub pixel column is connected by each of the at least two electrical switches that are connected in parallel to the column drive end, such that the column drive end charges the at least one mixed sub pixel column alternately through the at least two electrical switches.

2. The drive control circuit according to claim 1, wherein the mixed sub pixel column comprises a first sub pixel and a second sub pixel, and the at least two electrical switches of the at least set of electrical switches comprise a first electrical switch and a second electrical switch, and the at least two signals comprise a first signal and a second signal, and a control end of the first electrical switch is connected to the control end of the driver to receive the first signal, and a first end of the first electrical switch is connected to the column drive end, and a second end of the first electrical switch is connected to the first sub pixel, and a control end of the second electrical switch is connected to the control end of the driver to receive the second signal, and a first end of the second electrical switch is connected to the column drive end, and a second end of the second electrical switch is connected to the second sub pixel, and the control end outputs the first signal and the second signal to the switching unit and cooperates with the row by row scan of the row drive end so that the column drive end charges the sub pixels corresponded with the thin film transistors of the scanned row.

3. The drive control circuit according to claim 2, wherein the mixed sub pixel column further comprises a third sub pixel, and the third sub pixel is different from the first sub pixel and the second pixel, and the at least one set of electrical switches further comprises a third electrical switch, and the at least two signals further comprise a third signal, and a control end of the third electrical switch is connected to the control end of the driver to receive the third signal, and a first end of the third electrical switch is connected to the column drive end, and a second end of the third electrical switch is connected to the third sub pixel, and the control end outputs the first signal, the second signal and the third signal to the switching unit and cooperates with the row by row scan of the row drive end so that the column drive end charges the sub pixels corresponded with the thin film transistors of the scanned row.

4. The drive control circuit according to claim 3, wherein the control end of the driver comprises a first output end, a second output end and a third output end, and the first output end is connected to the control end of the first electrical switch to output the first signal, and the second output end is connected to the control end of the second electrical switch to output the second signal, and the third output end is connected to the control end of the third electrical switch to output the third signal.

5. The drive control circuit according to claim 3, wherein the first sub pixel is a red sub pixel, and the second sub pixel is a blue sub pixel, and the third sub pixel is a green sub pixel.

6. The drive control circuit according to claim 3, wherein the first electrical switch, the second electrical switch and the third electrical switch are all PNP type field effect transistors, and the control ends, the first ends and the second ends of the first electrical switch, the second electrical switch and the third electrical switch respectively are gates, drains and sources of field effect transistors.

7. The drive control circuit according to claim 1, wherein a structure of the sub pixel set is a pentile pixel structure.

8. A liquid crystal display device, comprising a drive control circuit, wherein the drive control circuit comprises a sub pixel set, a thin film transistor set, a switching unit, and a driver, and the driver comprises a control end, a row drive end and a column drive end, and the sub pixel set comprises a plurality of sub pixels arranged in an array that includes a first number of sub pixels, and the thin film transistor set comprises thin film transistors arranged in an array that comprises a second number of thin film transistors, the second number being identical to the first number of sub pixels, such that the thin film transistors respectively correspond to the sub pixels, wherein the sub pixel set comprises at least one mixed sub pixel column, and the mixed sub pixel column comprises at least two different sub pixels, and the at least one mixed sub pixel column is connected to the switching unit via the ones of the thin film transistors that correspond to the at least two different sub pixels, and control ends of the thin film transistors corresponding to the at least one mixed sub pixel column are connected to the row drive end, and the switching unit is also connected to the column drive end and the control end of the driver, and the control end outputs at least two signals to the switching unit and cooperates with a row by row scan of the row drive end so that the column drive end charges sub pixels corresponded with thin film transistors of a scanned row, wherein the at least two different sub pixels comprises a third number of different sub pixels and the at least two signals comprises a fourth number of signals and the fourth number is the same as the third number of the at least two different sub pixels, wherein the switching unit comprises at least one set of electrical switches that connects the at least one mixed sub pixel column to the column drive end; and wherein the at least one set of electrical switches comprises at least two electrical switches that are arranged parallel to each other and the at least one mixed sub pixel column is connected by each of the at least two electrical switches that are connected in parallel to the column drive end, such that the column drive end charges the at least one mixed sub pixel column alternately through the at least two electrical switches.

9. The liquid crystal display device according to claim 8, wherein the mixed sub pixel column comprises a first sub pixel and a second sub pixel, and each set of electrical switches corresponds to one mixed sub pixel column, and the at least two electrical switches of the at least set of electrical switches comprise a first electrical switch and a second electrical switch, and the at least two signals comprise a first signal and a second signal, and a control end of the first electrical switch is connected to the control end of the driver to receive the first signal, and a first end of the first electrical switch is connected to the column drive end, and a second end of the first electrical switch is connected to the first sub pixel, and a control end of the second electrical switch is connected to the control end of the driver to receive the second signal, and a first end of the second electrical switch is connected to the column drive end, and a second end of the second electrical switch is connected to the second sub pixel, and the control end outputs the first signal and the second signal to the switching unit and cooperates with the row by row scan of the row drive end so that the column drive end charges the sub pixels corresponded with the thin film transistors of the scanned row.

10. The liquid crystal display device according to claim 9, wherein the mixed sub pixel column further comprises a third sub pixel, and the third sub pixel is different from the first sub pixel and the second pixel, and the at least one set of electrical switches further comprises a third electrical switch, and the at least two signals further comprise a third signal, and a control end of the third electrical switch is connected to the control end of the driver to receive the third signal, and a first end of the third electrical switch is connected to the column drive end, and a second end of the third electrical switch is connected to the third sub pixel, and the control end outputs the first signal, the second signal and the third signal to the switching unit and cooperates with the row by row scan of the row drive end so that the column drive end charges the sub pixels corresponded with the thin film transistors of the scanned row.

11. The liquid crystal display device according to claim 10, wherein the control end of the driver comprises a first output end, a second output end and a third output end, and the first output end is connected to the control end of the first electrical switch to output the first signal, and the second output end is connected to the control end of the second electrical switch to output the second signal, and the third output end is connected to the control end of the third electrical switch to output the third signal.

12. The liquid crystal display device according to claim 10, wherein the first sub pixel is a red sub pixel, and the second sub pixel is a blue sub pixel, and the third sub pixel is a green sub pixel.

13. The liquid crystal display device according to claim 10, wherein the first electrical switch, the second electrical switch and the third electrical switch are all PNP type field effect transistors, and the control ends, the first ends and the second ends of the first electrical switch, the second electrical switch and the third electrical switch respectively are gates, drains and sources of field effect transistors.

14. The liquid crystal display device according to claim 8, wherein a structure of the sub pixel set is a pentile pixel structure.

* * * * *